US006036015A

United States Patent [19]

Ale' et al.

[11] Patent Number: 6,036,015

[45] Date of Patent: Mar. 14, 2000

[54] PACKAGE FOR LISTS OF MOSAIC TESSERAE AND THE LIKE

[76] Inventors: Camilo Ale', Via Genova 48, Marina di Carrara - Carrara (MS); JosèDino Ale', Via Genova 48, Marina di Carrata-Carrara (MS), both of Italy

[21] Appl. No.: 09/176,551

[22] Filed: Oct. 21, 1998

[30] Foreign Application Priority Data

Oct. 29, 1997 [IT] Italy ..... FI97A239

[51] Int. Cl.[7] ..... B65D 85/00

[52] U.S. Cl. ..... 206/460; 206/484

[58] Field of Search ..... 206/459.5, 457, 206/460, 484, 484.2, 495, 466, 525, 775

[56] References Cited

U.S. PATENT DOCUMENTS 5,161,687 11/1992 Kornell et al. ..... 206/460

5,568,866 10/1996 Grosskopf et al. ..... 206/460

*Primary Examiner*—Jacob K. Ackun

*Attorney, Agent, or Firm*—McGlew and Tuttle, P.C.

[57] ABSTRACT

A package of products for mosaic handworks, especially for lists of mosaic tesserae and the like, made up of a lower support element (3) on which the tesserae (2) of a list are laid and provided with edges (30) acting as guiding means for the list, and of a transparent upper element (4) for joining and covering the tesserae which is provided with a retaining edge (40) and with resolvable adhesive means for its association to the tessarae (2) and possibly also to the support element (3) (FIG. 2).

18 Claims, 2 Drawing Sheets

PACKAGE FOR LISTS OF MOSAIC TESSERAE AND THE LIKE

FIELD OF THE INVENTION

The present invention refers to a package of products for mosaic handworks and, in particular, to a package of lists for mosaic tesserae and the like, for example, tiles, marbles, frets, arrays of tesserae, etc.

BACKGROUND OF THE INVENTION

In the sector of the mosaic art, some work patterns, which used to be completed during the laying stage, are currently prepared prior to this stage.

In practice, the tesserae (or the other similar elements that make up a pattern, an ornament, etc.) are orderly grouped into lists of established dimensions and kept united by strips of opaque paper glued on the exposed or upper face of the tesserae.

Upon their disposition into place, such lists must be fixed on the surfaces to be coated, the latter being suitably treated with a binding agent. This operation may prove difficult to make and give rise to imperfections in the work because of the lack of a support able to guide the tesserae at the bottom and also because the strips, which keep the list of tesserae united, make it impossible to catch sight of the underlying tesserae.

The above indicated drawbacks may, therefore, contribute to deform, during the laying stage, the pattern previously composed with the tesserae, and/or induce errors in the junctions between the various portions of a given pattern.

SUMMARY AND OBJECTS OF THE INVENTION

The present invention overcomes the above problems by providing a package of products for mosaic handworks, especially a package of an arranged group or list for mosaic tesserae and the like, made up of a lower support and guide element and of an upper element for retaining and covering the tesserae.

According to the invention, an arranged group of tesserae package is provided including a plurality of tesserae disposed to form an arranged group of tesserae defining a portion of a pattern. A support element is disposed under the group of tesserae. A covering element is provided which covers the group of tesserae. The covering element is removably connected to an upper face of the group of tesserae. The covering element is also at least partially removably connected to the support element. The covering element joins each tesserae of the plurality of tesserae to each other tesserae of the plurality of tesserae.

The advantages deriving from the present invention include the possibility of maintaining the integrity of the pattern formed by the tesserae of each list and, at the same time, of accurately and easily joining the pattern portion relevant to each list of tesserae with the portions of pattern adjacent thereto.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DESCRIPITION OF THE PREFERRED EMBODIMENT

Figure 1:
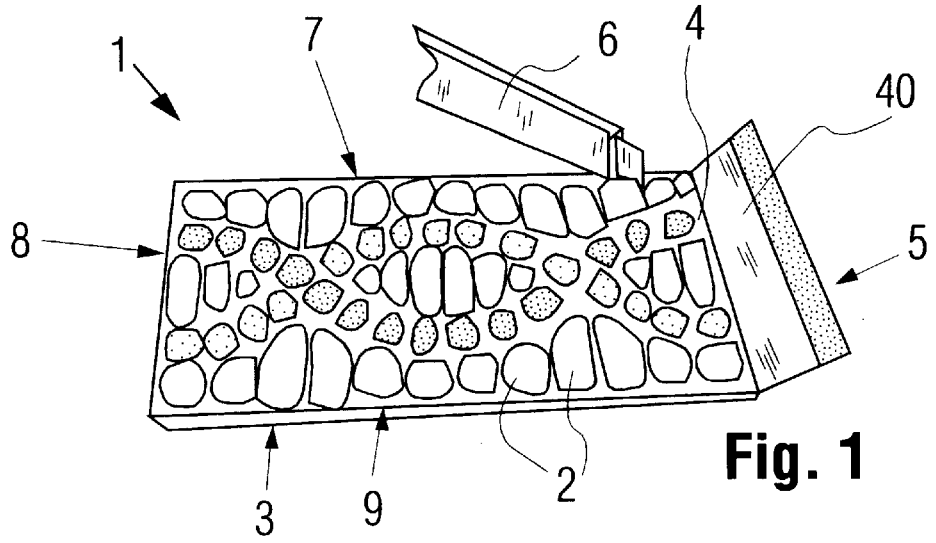
FIGS. 1, 2, 3, 4, 5 represent, in different scales, an embodiment of the present invention illustrated according to possible sequential laying stages, respectively, in top perpsective view (FIG. 1), in rear-side perspective view (FIG. 2), in top perspective view (FIG. 3), in plan view from above (FIG. 4) and in top perspective view (FIG. 5).
Figure 2:
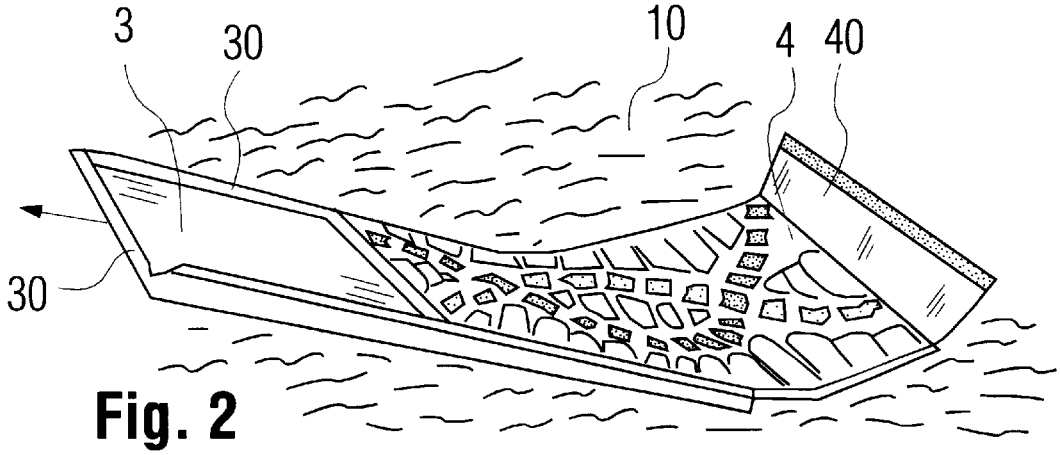
Figure 3:
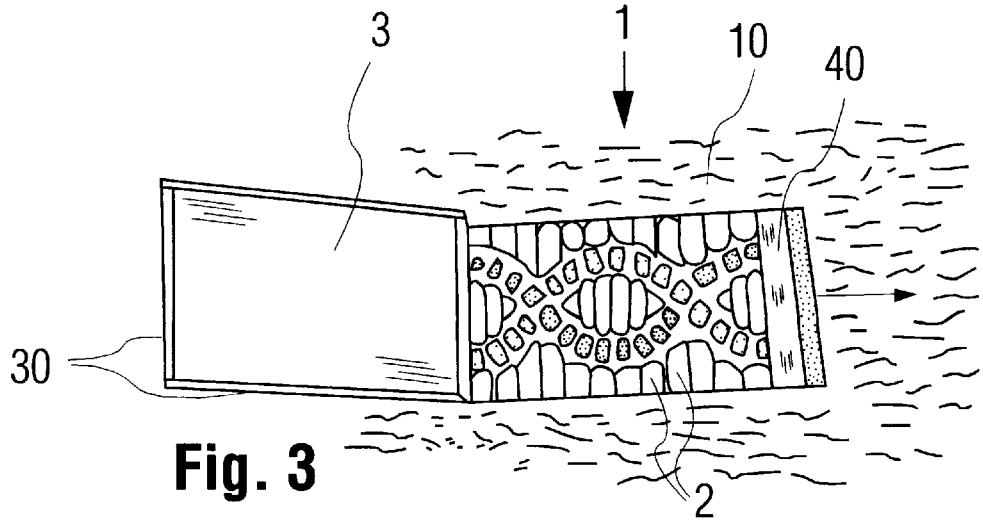
Figure 4:
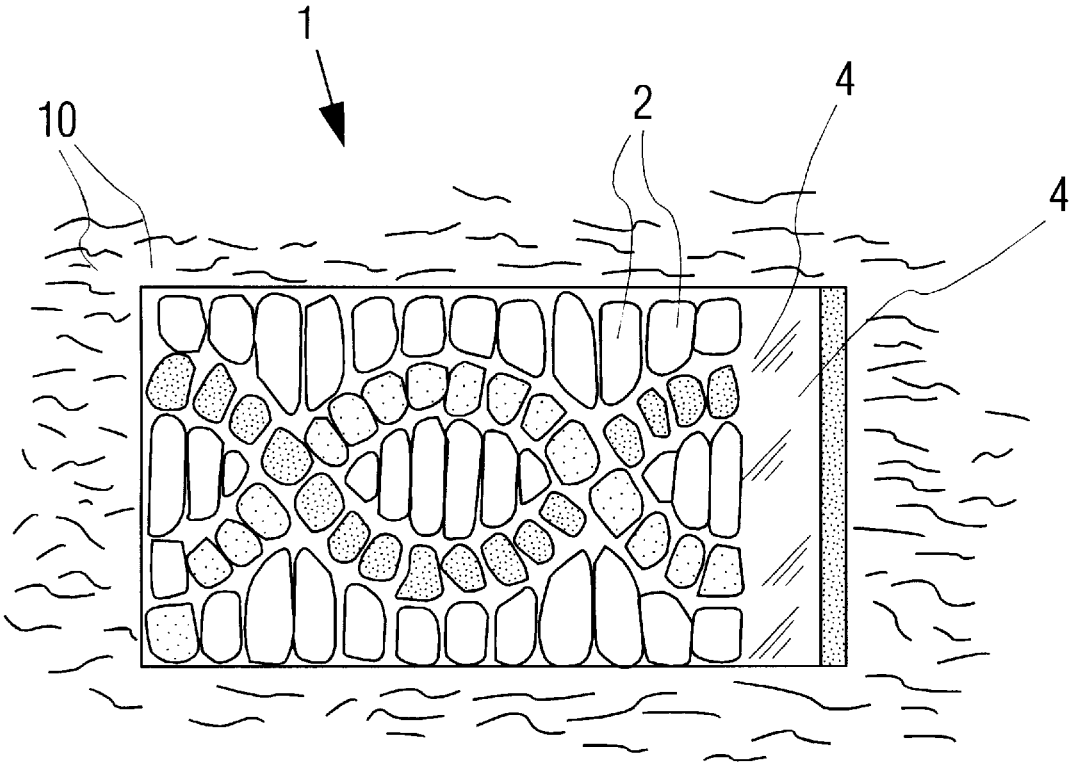

With reference to the drawings of the attached figures which, as mentioned above, are just an examplary embodiment of the invention, a package (1) for an arranged group or a list of mosaic tesserae (2) comprise a lower support element (3) and an upper element (4) for reatining and covering the tesserae.

The lower support element (3) may be made and/or shaped in different ways. For example, it may be made of paper, cardboard, corrugated board, plastics material, metal sheet, etc., and may be more or less rigid. Moreover, the support element (3) is advantageously provided with peripheral raised edges (30) able to define, at least partially, a frame for retaining the supported list of tesserae (3). The height of such edges (30) will correspond to the thickness of the tesserae (2). One function of said support element (3) is to support the tessearae (2) to allow them to be laid in place more suitably. Moreover, the support element (3) allows a significant improvement in the packing, storage and transportation of a number of the same lists.

The upper covering element (4) holds and covers the upper surface of the tesserae (2) and results restrained by glueing (or other technically equivalent means) thereto. The upper covering element (4) may be made of self-stick paper or plastics, or being spread with adhesive material, and is advantageously of transparent material enabling the user to catch sight of the tesserae (2) being covered up.

The upper covering element (4) may be extended, as illustrated in the figures, over a surface slightly larger than the list of tesserae (2), so as to define a free edge or tab (40) making up a hold for manually removing the list from its support and subsequently detaching the covering element (4) from the list of tesserae (2) when the latter are put in place. The tab (40) illustrated in the attached drawings extends over a length substantially equal to the whole width of the package (1); the tab (40) being possibly shaped and/or constructed in different ways, for example in the form of a holding element separated from the covering element (4) but associated thereto.

The package may advantageously consist of an assembly in which the two elements for supporting (3) and covering (4) the tesserae are mutually engaged.

The procedure that can be followed in order to lay in place the tesserae contained in the package (1) is the one illustrated by way of example in the attached figures, starting with FIG. 1 and then referring to the others in progressive order. As a first operation (FIG. 1), the covering element (4) is removed from the rest of the package (1) only in correspondence of the opening side (5) by lifting up the tab (40) and thereby uncovering the package (1) on such side (5).

Thereafter, by using a cutting tool (6) partially shown in FIG. 1, the two elements (3) and (4) are separated from the package (1) by making a cut on the remaining three sides (7, 8, 9).

At this point, the list of tesserae (2) remains engaged only to the covering element (4) and can be transferred onto the surface (10) to be coated and on which the glue or other binder has been predisposed.

Such operation is performed either by holding and pulling the tab of the covering element, thereby making the same list sliding along the support element (3) and then laying the list of tesserae (2) on the surface (10) to be coated, or, after having pulled out a portion of the support list, by pressing the latter onto the surface to be coated and, afterwards, while withdrawing the support (3) with one hand, progressively exerting a pressure with the other hand on the list thus freed from the support.

Figure 5:
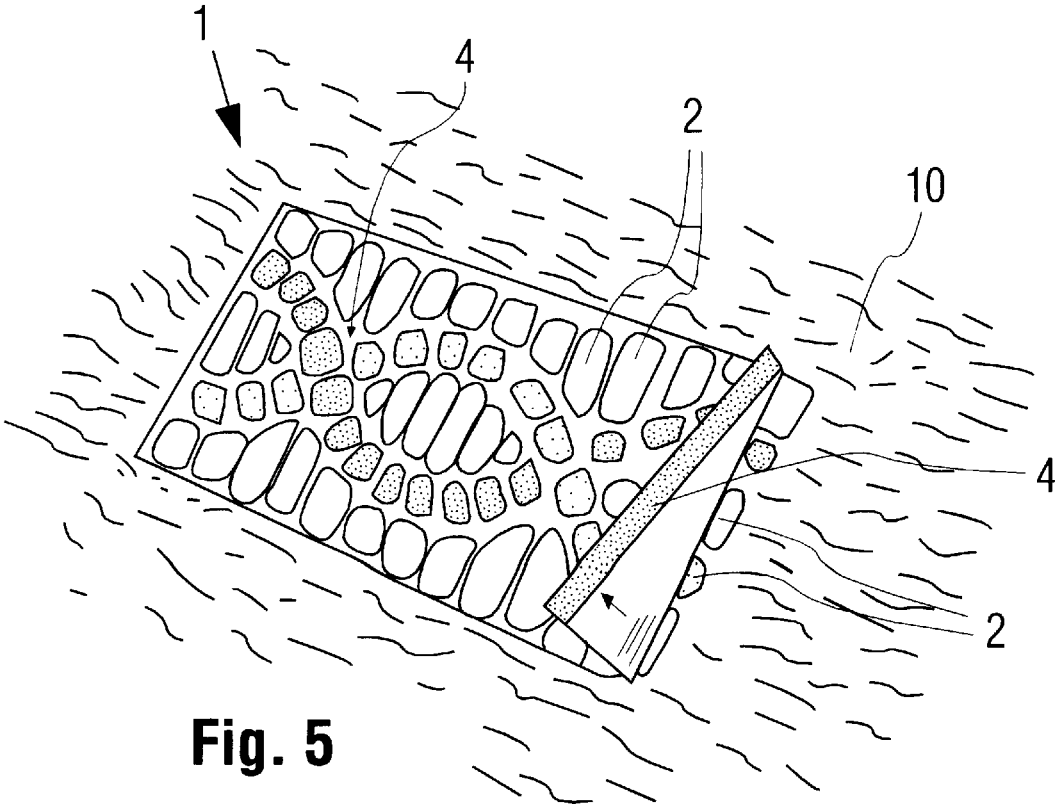

Said sliding can be made easier thanks to the support frames (7) and (9) which are disposed opposite to each other to define guide means. Once the list of tesserae (2) is laid on the binder and the time for the necessary adhesion is elapsed, it is possible to separate the covering element (4) by exerting a draw through the tab (40) in a way similar to that illustrated in FIG. 5.

DESCRIPTION OF A FURTHER EMBODIMENT

According to a further embodiment of the present invention, said element for joining and covering the tesserae (2) is apt to be associated to the exposed face of same tesserae without engaging the support element (3), and it may be of a shape and dimensions substantially corresponding to those of the list defined by the assembly of tesserae (2). The list, with the thus joined tesserae (2) is able to be engaged with the support element (3) by means of a plastics sheet or the like—for example, a film of transparent, thermoshrinking plastics material known per se—intended to wrap up the whole and be removed upon the laying of the handwork.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

We claim:

1. An arranged group of tesserae package, comprising:

a plurality of tesserae disposed to form an arranged group of tesserae defining a portion of a pattern;

a support element disposed under said group of tesserae;

a covering element covering said group of tesserae and being removably connected to an upper face of said group of tesserae and being at least partially removably connected to said support element, said covering element joining each tesserae of said plurality of tesserae to each other tesserae of said plurality of tesserae.

2. The arranged group of tesserae package according to claim 1, wherein said covering element is made of transparent material.

3. The arranged group of tesserae package according to claim 1, wherein said covering element extends beyond said arranged group of tesserae to define a holding flap, whereby the holding flap can be grasped by a user allowing the removal of the support element and of the covering element from said arranged group of tesserae.

4. The arranged group of tesserae package according to claim 1, wherein said covering element extends over an area substantially equal to a surface area of said arranged group of tesserae and said covering element is connected to said support element over an entire perimeter of said support element.

5. The arranged group of tesserae package according to claim 1, wherein said covering element fully wraps up and encloses said arranged group of tesserae and said support element.

6. The arranged group of tesserae package according to claim 1, wherein said support element includes peripheral raised edges extending on sides of said arranged group of tesserae to contain said arranged group of tesserae laterally.

7. The arranged group of tesserae package according to claim 1, wherein said support element includes said raised edges at two opposite sides of said arranged group of tesserae so as to define two guides for sliding said list of tesserae on said support.

8. An tesserae package, comprising:

a plurality of tesserae disposed to form an arranged group of tesserae defining a portion of a pattern;

a support element disposed under said arranged group of tesserae;

a covering element covering said group of tesserae and being removably connected to an upper face of each of said plurality of tesserae of said group of tesserae to join said plurality of tesserae of said group in a relative position corresponding to said portion of a pattern, said covering element being removably connected to said support element.

9. The tesserae package according to claim 8, wherein said covering element is made of transparent material.

10. The tesserae package according to claim 8, wherein said covering element extends beyond said arranged group of tesserae to define a holding flap, whereby the holding flap can be grasped by a user allowing the removal of the support element and of the covering element from said arranged group of tesserae.

11. The tesserae package according to claim 8, wherein said covering element extends over an area substantially equal to a surface area of said arranged group of tesserae and said covering element is connected to said support element over an entire perimeter of said support element.

12. The tesserae package according to claim 8, wherein said covering element fully wraps up and encloses said arranged group of tesserae and said support element.

13. The arranged group of tesserae package according to claim 8, wherein said support element includes peripheral raised edges extending on sides of said arranged group of tesserae to contain said arranged group of tesserae laterally.

14. The arranged group of tesserae package according to claim 8, wherein said support element includes said raised edges at two opposite sides of said arranged group of tesserae so as to define two guides for sliding said list of tesserae on said support.

15. A method for the laying of a planar structure formed of a plurality of tesserae disposed to form a pattern on a surface to be coated, the method comprising the steps of:

disposing an arranged group of tesserae, forming a portion of said pattern, on a support element;

covering an upper face of the arranged group of tesserae with a covering element having a surface with adhesive, the adhesive surface contacting each tesserae of the arranged group of tesserae, and the adhesive surface having a peripheral portion covering a portion of said support element to form a package assembly in which the supporting element and the covering element are mutually engaged;

releasing the peripheral portion of the covering element to remove the supporting element from said package assembly;

predisposing a binder on the surface to be coated;

disposing a remainder of the package assembly on the surface to be coated;

removing the covering element from the arranged group of tesserae.

16. The method according to claim 15, wherein the covering element is made of transparent material.

17. The method according to claim 16, wherein the peripheral portion of the covering element extends beyond the upper face of the arranged group of tesserae to define a holding flap allowing the removal of the covering element from the support element.

18. The method according to claim 16, wherein subsequent to said step of releasing the peripheral portion of the covering element the method further comprises:

providing another package assembly;

releasing the peripherical portion of the covering element of the another package assembly;

removing the supporting element from the another package assembly;

disposing a remainder of the another package assembly on the surface to be coated, near to the group of tesserae already fixed in such a way as to continue the pattern; and when the arranged group of tesserae of the another package assembly is fixed to the surface removing the covering element from the another group of tesserae.

* * * * *